US008443525B2

(12) United States Patent
Reschke

(10) Patent No.: US 8,443,525 B2
(45) Date of Patent: May 21, 2013

(54) PICTURE LOCATING TOOL

(75) Inventor: Ernest J. Reschke, Shelby Township, MI (US)

(73) Assignee: Ernest J. Reschke, Shelby Township, MI (US)

( * ) Notice: Subject to any disclaimer, the term of this patent is extended or adjusted under 35 U.S.C. 154(b) by 212 days.

(21) Appl. No.: 13/114,436

(22) Filed: May 24, 2011

(65) Prior Publication Data

US 2012/0298830 A1 Nov. 29, 2012

(51) Int. Cl.
*A47G 1/16* (2006.01)
*A47G 1/24* (2006.01)
*A47G 1/20* (2006.01)

(52) U.S. Cl.
CPC ..... *A47G 1/205* (2013.01)
USPC ..... 33/613; 33/666; 248/469

(58) Field of Classification Search
CPC ..... A47G 1/205
USPC ..... 33/613, 666, 668; 248/469
See application file for complete search history.

(56) References Cited

U.S. PATENT DOCUMENTS 3,516,165 A * 6/1970 Pfeffer ..... 33/574
4,141,612 A 2/1979 Rowe
4,382,337 A * 5/1983 Bendick ..... 33/574
4,384,648 A * 5/1983 Hart et al. ..... 206/527
4,455,756 A * 6/1984 Greene ..... 33/613
4,517,860 A * 5/1985 Dameron, Jr. ..... 81/487
5,867,917 A 2/1999 Karon
6,000,142 A 12/1999 Deaton
6,049,991 A 4/2000 Gruenberg et al.
6,185,831 B1 * 2/2001 Pluciennik ..... 33/613
6,449,863 B1 * 9/2002 Voorhees ..... 33/613
6,574,880 B2 * 6/2003 Lombardo ..... 33/666
6,971,184 B2 * 12/2005 Prevost ..... 33/613
7,226,032 B2 6/2007 Schlais et al.
7,316,078 B2 * 1/2008 Hagman ..... 33/613
7,484,311 B2 * 2/2009 Bommarito ..... 33/613
7,566,042 B1 7/2009 Yates
7,797,853 B2 * 9/2010 Compton ..... 33/613
7,832,702 B2 11/2010 Yates
7,954,782 B2 * 6/2011 Harralson et al. ..... 248/469
2006/0278804 A1 12/2006 Hagman
2009/0045315 A1 2/2009 Harralson et al.

* cited by examiner

*Primary Examiner* — Christopher Fulton
(74) *Attorney, Agent, or Firm* — Christopher W. Quinn

(57) ABSTRACT

A hanging tool for hanging an ornamental object, e.g., a picture, on a wall includes an extension pole having an anchor attachment attached to an upper end of the extension pole. The anchor attachment includes an anchor for supporting the ornamental object in a laterally offset position relative to the wall. The anchor is disposed along a substantially horizontal axis extending through the anchor attachment. The anchor attachment defines a marking bore offset from the anchor and angled relative to the axis of the anchor to position a marking device, e.g., a pencil, at the intersection of the axis of the anchor and the wall in order to mark the wall and transfer the vertical location of the anchor to the wall.

20 Claims, 13 Drawing Sheets

PICTURE LOCATING TOOL

TECHNICAL FIELD

The invention generally relates to a locating tool for positioning an ornamental object, e.g., a picture, on a wall, and a method of positioning the ornamental object on the wall with the locating tool.

BACKGROUND

The first step in hanging a picture on a wall is to determine the desired position of the picture. In most instances, one person will hold the picture against a wall, while another person standing back from the wall provides input to the holder on the desired height and horizontal position. If the person holding the picture wants to see if the placement is adequate, the two individuals must switch positions. If only one person is trying to hang a picture, that individual must hold the picture against the wall and determine if the location is adequate without the benefit of viewing the proposed location from a distance.

This process can be difficult in locating the proper position for the picture because there are numerous picture hanger types available. One type is a wire attached on the back of a picture frame used to catch a wall anchor. Although the picture location may be determined, the location to place the wall anchor for the wire is not known. To do so would include additional steps of measuring the distance from the wire to the top of the frame and transferring that distance to the desired picture location on the wall. This process often leads to mistakes which can generate several holes in the wall while trying to locate the proper picture location.

Arranging groups of pictures is especially difficult because it involves arranging them with respect to each other and the wall space available. Any improperly aligned pictures stand out to the observer and the desired arrangement configuration is not achieved.

The most common method in locating where to hang pictures involves two individuals, a tape measure, level, and/or a laser. This process requires one person to hold the picture and the other person to determine the correct picture location. U.S. Pat. No. 6,049,991, Picture Hanging Position Marking Tool, uses a hand held device to determine the desired spot to hang a picture. U.S. Pat. No. 7,566,042, Picture Hanging Apparatus, is similar in that it uses a pole leaned up against a wall to temporarily suspend pictures. Pictures are suspended with a chain and the picture height is adjusted by lengthening or shortening the chain or repositioning the pole. The picture location is determined by the position of the hook once the picture is removed. The Picture Hanging Apparatus, however, impedes the view of the picture while positioning it. U.S. Pat. No. 7,954,782, Picture Hanging Position Finder and Wall Marking Device, is also similar in that it uses an elongated adjustable vertical support to temporarily suspend a picture. It requires, however, the entire wall to support a temporarily suspended picture. Users wanting to hang pictures over an opening, such as a window, arch, or soffit, cannot do so with the Picture Hanging Position Finder and Wall Marking Device. The Picture Hanging Position Finder and Wall Marking Device also requires a smooth wall to temporarily suspend a picture and implement the wall marking device. Any wall obstructions, such as wall molding, window sills, power outlets, light switches, thermostats, hand railing, etc, render the Picture Hanging Position Finder and Wall Marking Device impractical and useless.

The deficiencies in prior technology are several. One, using the most common method in locating where to hang pictures involving two individuals, a tape measure, level, and/or laser is challenging and often difficult. Having one person hold the picture against the wall while the other decides where it looks best often leads to frustration and several holes in the wall. Using the item in U.S. Pat. No. 6,049,991, Picture Hanging Position Marking Tool, does not allow the user to stand back and determine if the proposed picture hanging location is satisfactory. Second, using the item in U.S. Pat. No. 7,566,042, Picture Hanging Apparatus, impedes the view of the picture while determining the desired picture location and is unstable. Third, using the item in U.S. Pat. No. 7,954,782, Picture Hanging Position Finder and Wall Marking Device, is impractical because it only works if the wall is completely flat and it can be used only for very light pictures. Heavy pictures cannot be used with this device because the top section of the vertical support arm will bend the entire device away from the wall. This device also possesses a high degree of risk in damaging the wall because the vertical support touches the entire wall during the process of temporarily hanging a picture.

SUMMARY

A locating tool for positioning an ornamental object on a wall is provided. The locating tool includes a pole that extends along a longitudinal axis between a first end and a second end. A base is attached to the first end of the extension pole. The base is configured for supporting the first end of the extension pole in a laterally offset position relative to the wall. An anchor attachment is attached to the second end of the extension pole. The anchor attachment includes an anchor that is disposed on an axis that extends transverse relative to the wall and through the anchor attachment. The anchor is configured for supporting the ornamental object in a laterally offset position relative to the wall. The anchor attachment defines a marking bore that is offset from the anchor. The marking bore is angled relative to the axis of the anchor. The marking bore is configured for positioning a marking device at an intersection of the axis of the anchor and the wall to transfer a vertical position of the anchor to the wall.

A picture locating tool for positioning a picture at a desired location on a wall is also provided. The picture locating tool includes an adjustable extension pole that is extendable along a longitudinal axis between a first end and a second end thereof. A bi-pod base having a first leg and a second leg is attached to the first end of the extension pole. The first leg and the second leg are disposed in a co-planar relationship with the extension pole. Each of the first leg and the second leg extend from the extension pole to a distal foot, while diverging from each other to define a support width between the distal foot of the first leg and the distal foot of the second leg. The distal foot of the first leg and the distal foot of the second leg support the first end of the extension pole in a laterally offset position relative to the wall. The support width is equal to or less than twelve inches. An anchor attachment is attached to the second end of the extension pole. The anchor attachment includes an anchor that is disposed on an axis. The axis of the anchor extends transverse relative to the wall and through the anchor attachment. The anchor is configured for supporting the ornamental object in a laterally offset position relative to the wall. The anchor attachment includes at least one bumper that is attached adjacent an upper vertical edge of the anchor attachment. The bumper is positioned opposite the anchor for engaging the wall. The extension pole is supported relative to the wall and the floor by only the bumper, the distal foot of the first leg and the distal foot of the second leg. The anchor attachment defines a marking bore that is vertically offset below the anchor and angled relative to the axis of the anchor at an angle of between six degrees (6°) and thirty three degrees (33°). The marking bore is configured for positioning a marking device at an intersection of the axis of the anchor and the wall to transfer a vertical position of the anchor to the wall. The bumper, the distal foot of the first leg and the distal foot of the second leg are configured to support the extension pole in an angled relationship relative to the wall at an angle of between two degrees (2°) and twelve degrees (12°), so that the marking bore is properly aligned with the axis of the anchor to position the marking tool at the intersection of the axis of the anchor and the wall.

A method of hanging an ornamental object on a wall is also provided. The method includes extending a locating tool to a desired length sufficient to support the ornamental object at a desired height on a wall. A base of the locating tool is positioned at a pre-determined distance from the wall. The locating tool is leaned against the wall until a bumper disposed at an upper vertical edge of an anchor attachment of the locating tool contacts the wall. The locating tool is laterally positioned relative to the wall to select a desired lateral location for the ornamental object on the wall. A marking tool is inserted through a marking bore defined by the anchor attachment. The marking bore is offset relative to an anchor of the anchor attachment and angled relative to an axis of the anchor such that the marking tool contacts the wall at an approximate intersection between the axis of the anchor and the wall. The wall is marked with the marking tool to transfer the vertical and lateral location of the anchor to the wall. Hanging hardware is installed on the wall at the marked vertical location to support the ornamental object.

Accordingly, the locating tool may be used by a single person, and allows the user to temporarily position the ornamental object, e.g., a picture, at the desired location on the wall in such a manner that does not impede the view of the ornamental object. Additionally, the locating tool allows the single user to back away from the ornamental object to better view the position of the ornamental object and determine if the position requires adjustment. The locating tool allows for easy adjustment until the desired position is located, at which time the ornamental object may be removed from the locating tool and the exact location for hanging hardware may be marked on the wall in order to hang the ornamental object on the wall in the desired location.

The above features and advantages and other features and advantages of the present invention are readily apparent from the following detailed description of the best modes for carrying out the invention when taken in connection with the accompanying drawings.

DETAILED DESCRIPTION

Those having ordinary skill in the art will recognize that terms such as "above," "below," "upward," "downward," "top," "bottom," etc., are used descriptively for the figures, and do not represent limitations on the scope of the invention, as defined by the appended claims.

Figure 1:
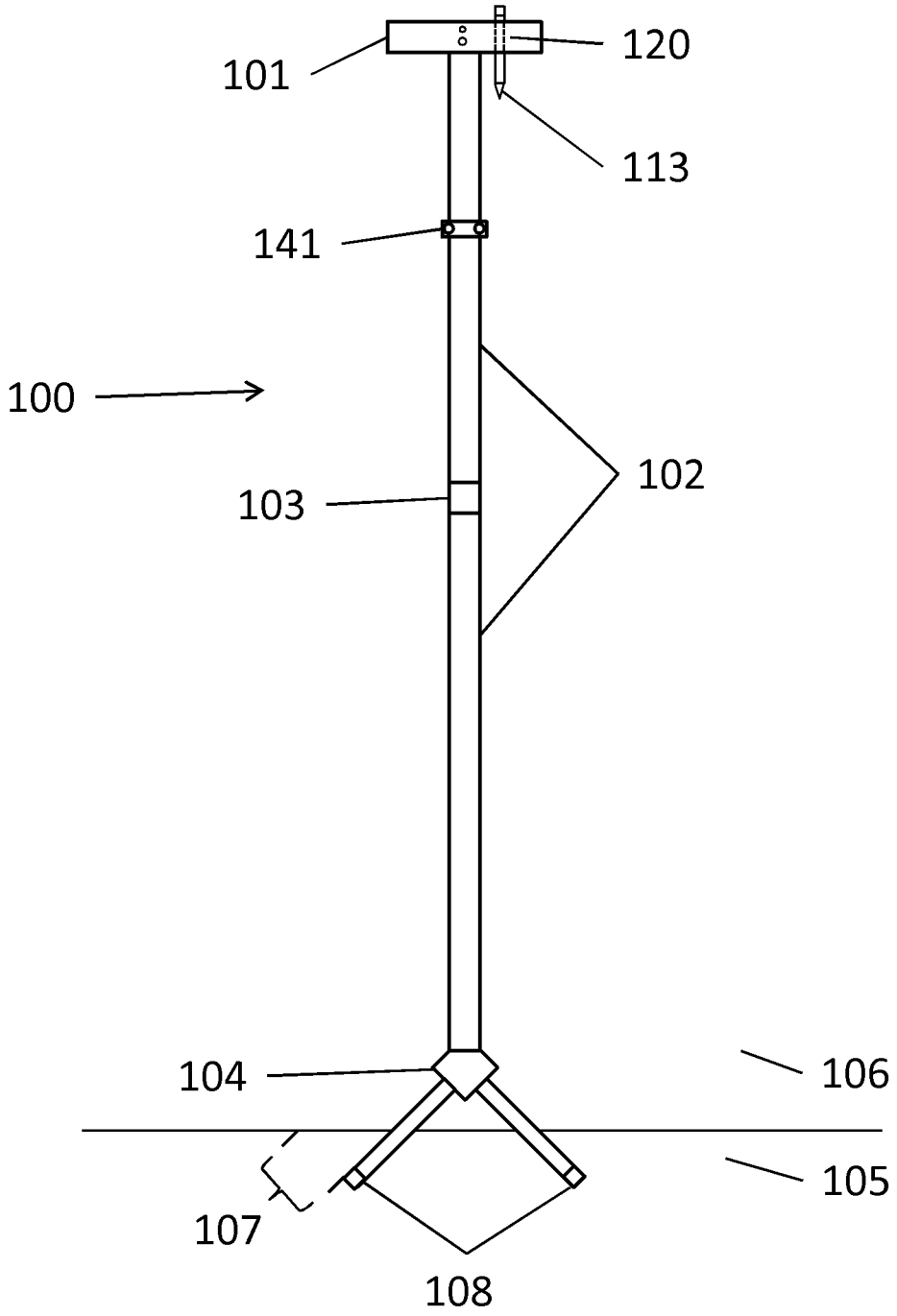
FIG. 1 is a plan view of a picture locating tool (front).
Figure 2:
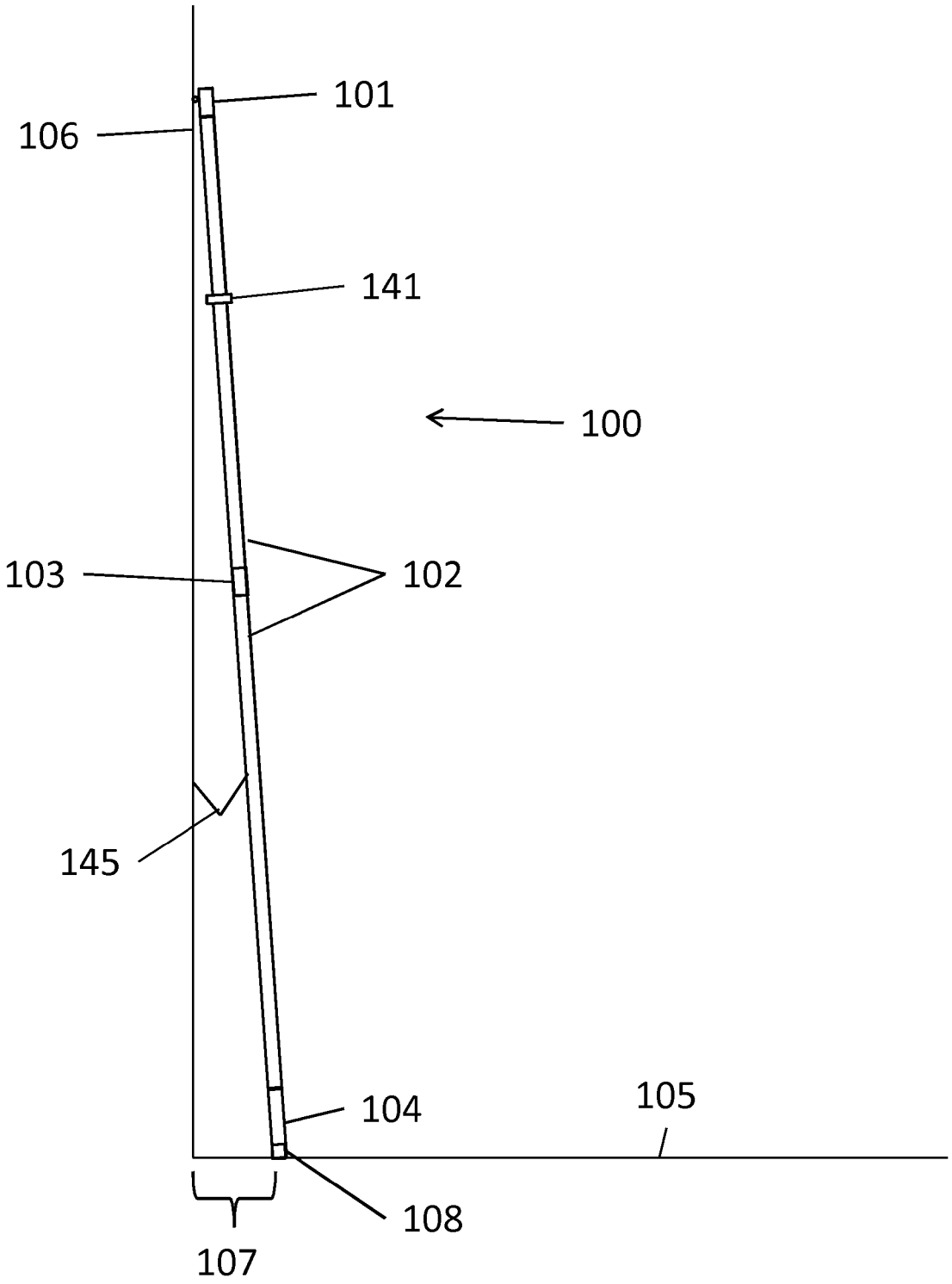
FIG. 2 is a plan view of the picture locating tool (side).

Referring to the Figures, wherein like numerals indicate like parts throughout the several views, a picture locating tool is generally shown at 100. Referring to FIGS. 1 and 2, the picture locating tool 100 includes a picture hanging anchor attachment 101 attached to a top section of an adjustable extension pole 102. A bi-pod base 104 is attached to a lower section of the adjustable extension pole 102. The top section of the extension pole 102 includes a picture frame stabilizer ring 141. Each bi-pod leg has a rubber shoe 108 that is attached to a distal end of each bi-pod leg. The adjustable extension pole 102 has an outer lock device 103 to lock the extension pole 102 at a desired height measurement. A marking device 113 is positioned in a cavity 120 located in the picture hanging anchor attachment 101. In this embodiment, the bi-pod base 104 is placed a distance 107 from an intersection of the wall 106 and the floor 105. Preferably, the distance 107 is equal to 5 inches.

Figure 3:
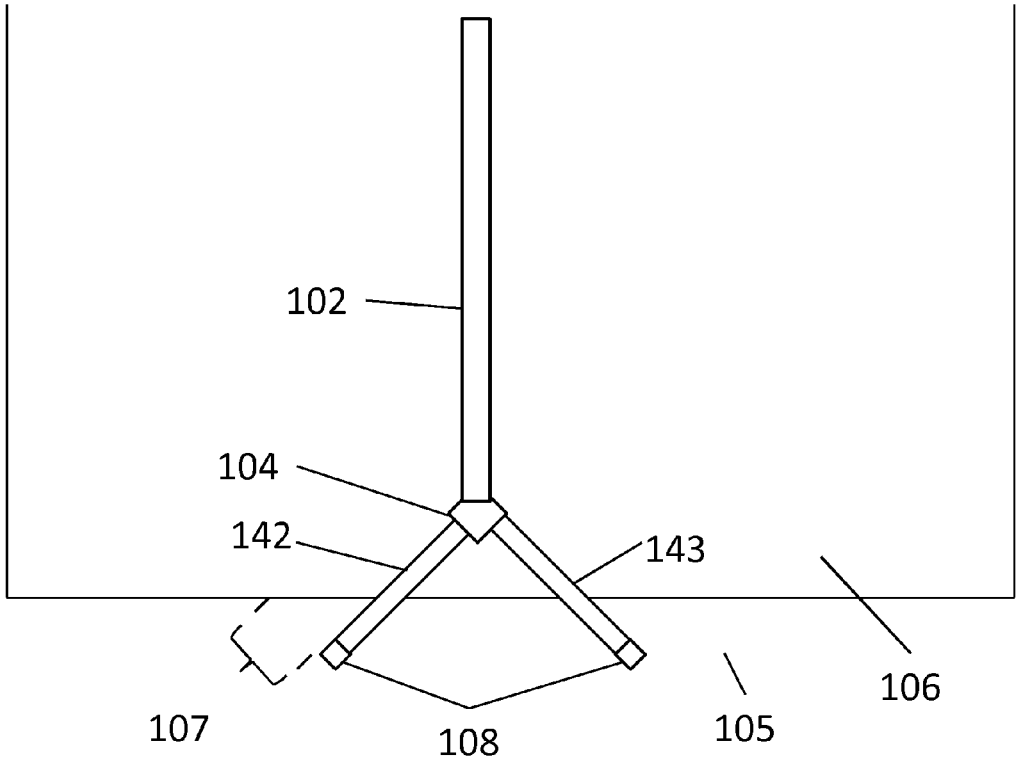
FIG. 3 is a plan view of a set of bi-pod legs (front) of the picture locating tool.
Figure 4:
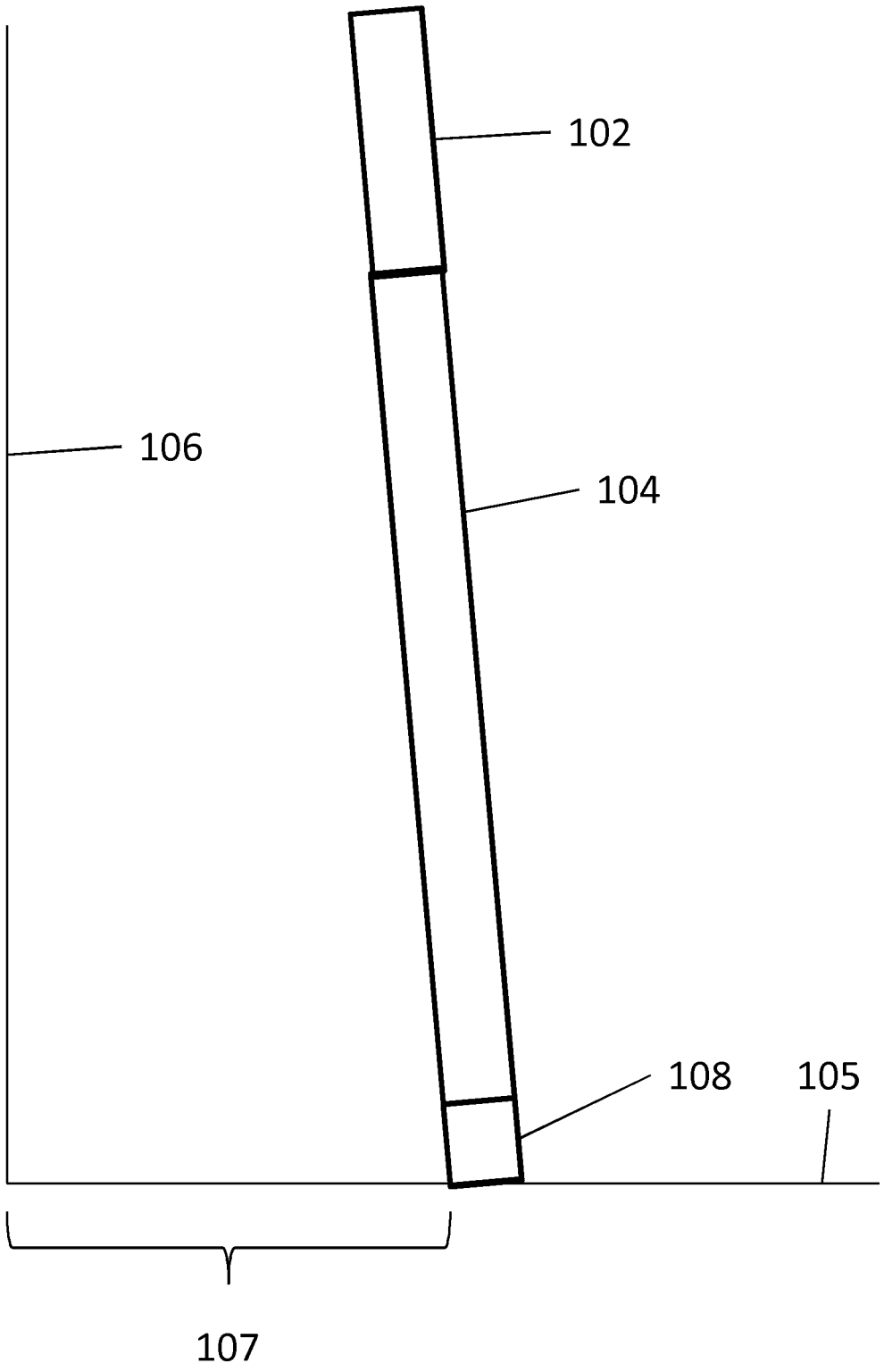
FIG. 4 is a plan view of the bi-pod legs (side).

Referring to FIGS. 3 and 4, the lower section of the picture locating tool 100 is shown. The bi-pod base 104 is attached to the lower section of the adjustable extension pole 102. As shown in FIG. 3, the bi-pod base 104 includes a first leg 142 and a second leg 143. Each leg 142, 143 of the bi-pod base 104 includes a rubber shoe 108 that is attached to a distal foot of the leg. When the bi-pod base 104 is placed at the preferred distance 107 from the wall 106, (5 inches) the bi-pod base provides a stable platform to hang the ornamental object 115 (shown in FIGS. 9-13) on the picture hanging anchor attachment 101.

Figure 5:
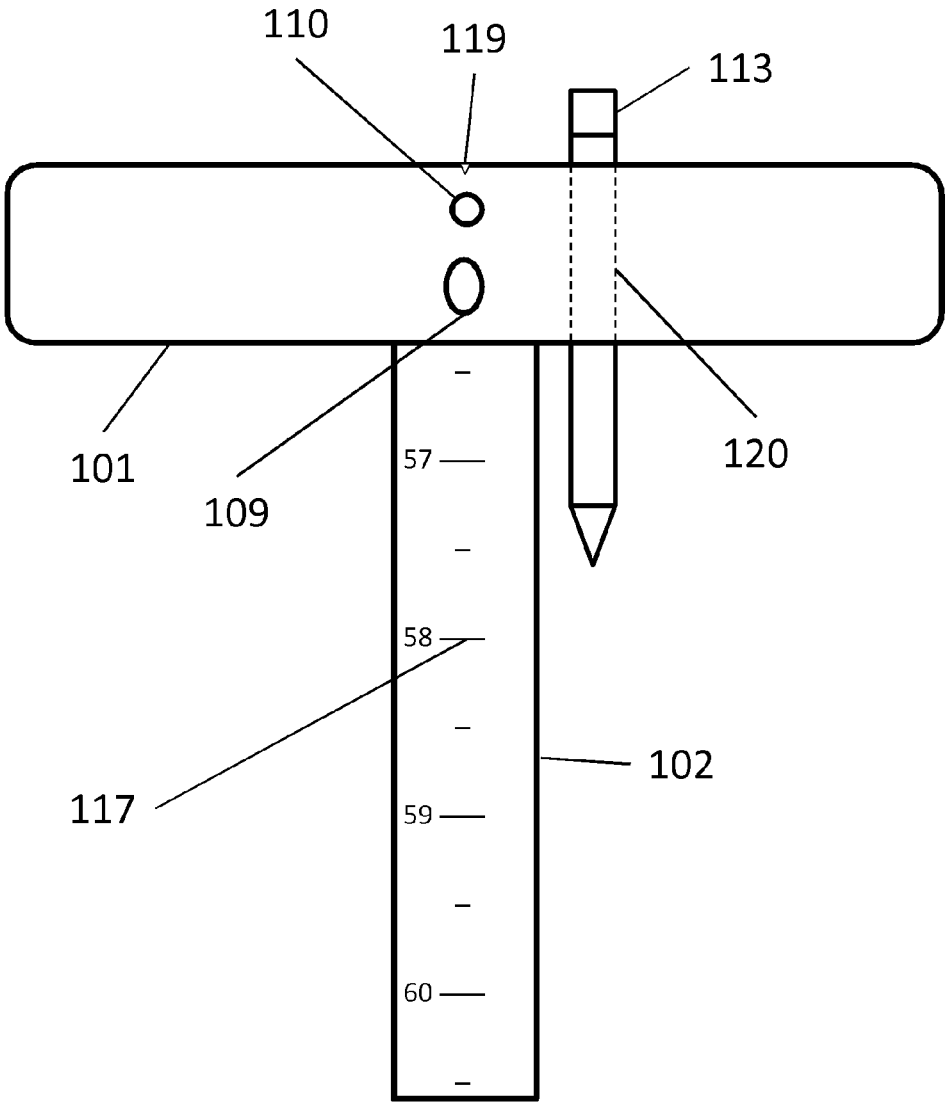
FIG. 5 is a plan view of a picture hanging attachment (front) of the picture locating tool.

Referring to FIG. 5, the top section of the picture locating tool 100 is shown. The picture hanging anchor attachment 101 is attached to the top section of the adjustable extension pole 102. The picture hanging anchor attachment 101 includes a picture anchor 110 that defines an anchor point for the ornamental object 115 (shown in FIGS. 9-13). The picture hanging anchor attachment 101 further defines a marking bore 109 for the user to insert a marking device 113 and mark the wall at the proper picture hanging location. The picture hanging anchor attachment 101 may include a vertical indicator 119. The marking device 113 may be positioned within a cavity 120. The vertical indicator 119 aids the user in aligning multiple ornamental objects on the wall 106. The top section of the adjustable extension pole 102 may include a height measurement indicator 117, showing the relative height from the anchor 110 to the floor 105 in inches.

Figure 6:
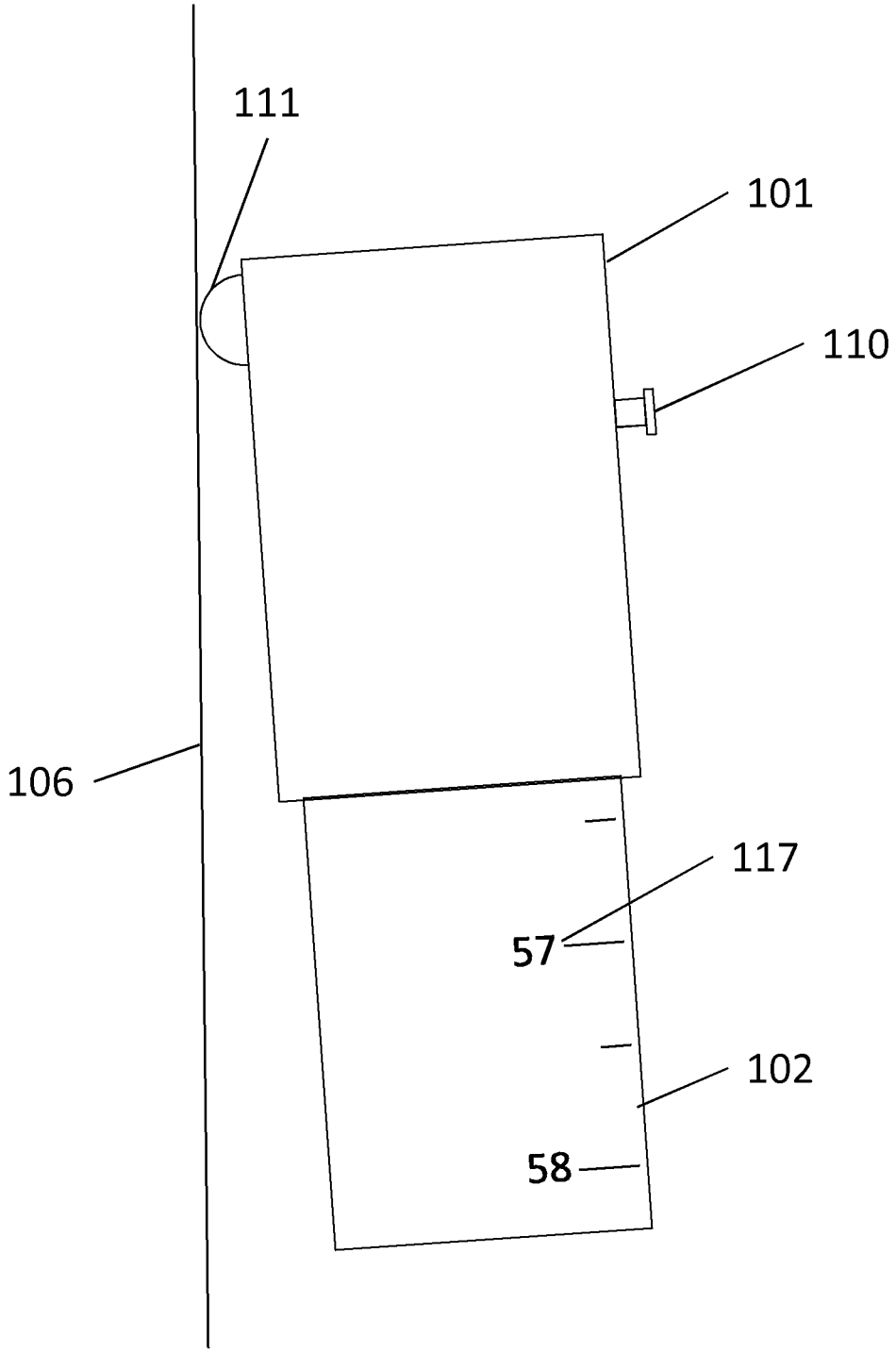
FIG. 6 is a plan view of the picture hanging attachment (side).

Referring to FIG. 6, the top section of the picture locating tool 100 is shown from a side plan view. The picture hanging anchor attachment 101 is attached to the top section of the adjustable extension pole 102. In this embodiment, the picture hanging anchor attachment 101 is configured with the picture anchor 110 and contact bumpers 111. The contact bumpers 111 support the picture locating tool 100 relative to the wall 106. On the top section of the adjustable extension pole 102 is the attached height measurement indicator 117.

Figure 7:
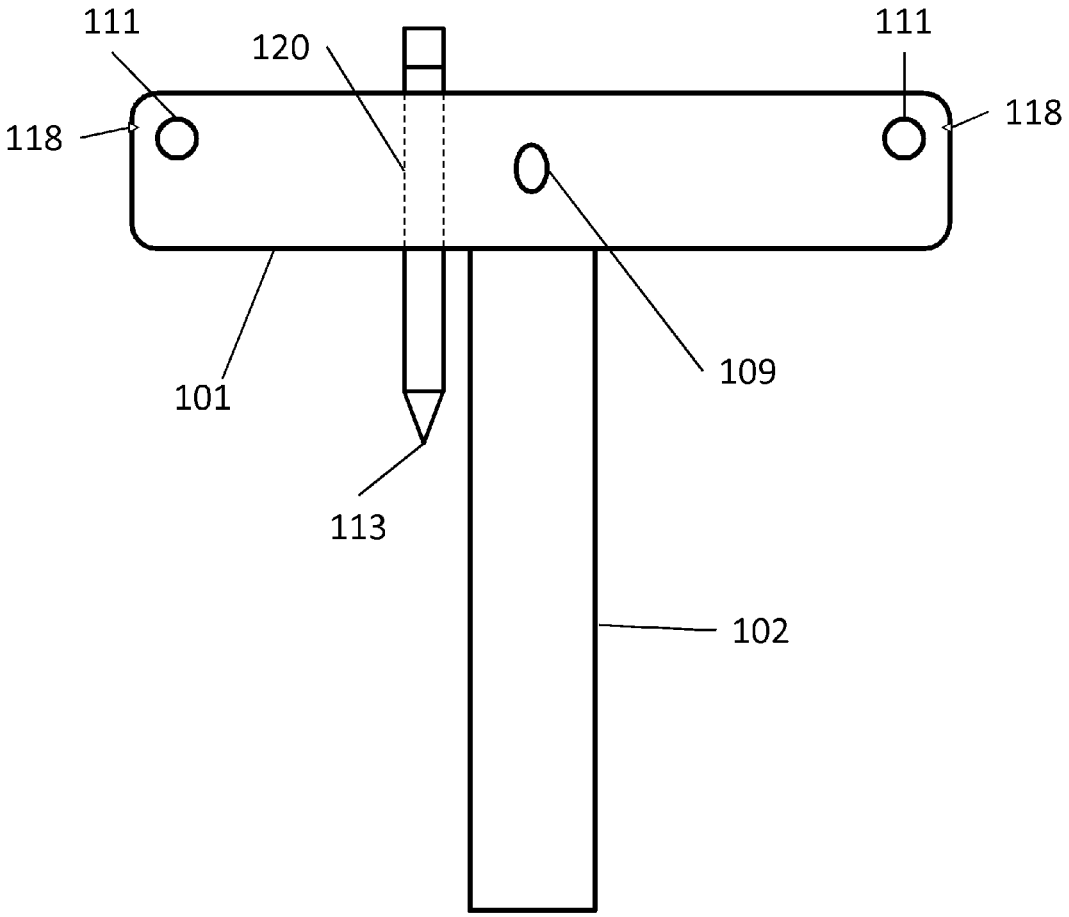
FIG. 7 is a plan view of the picture hanging attachment (back).
Figure 8:
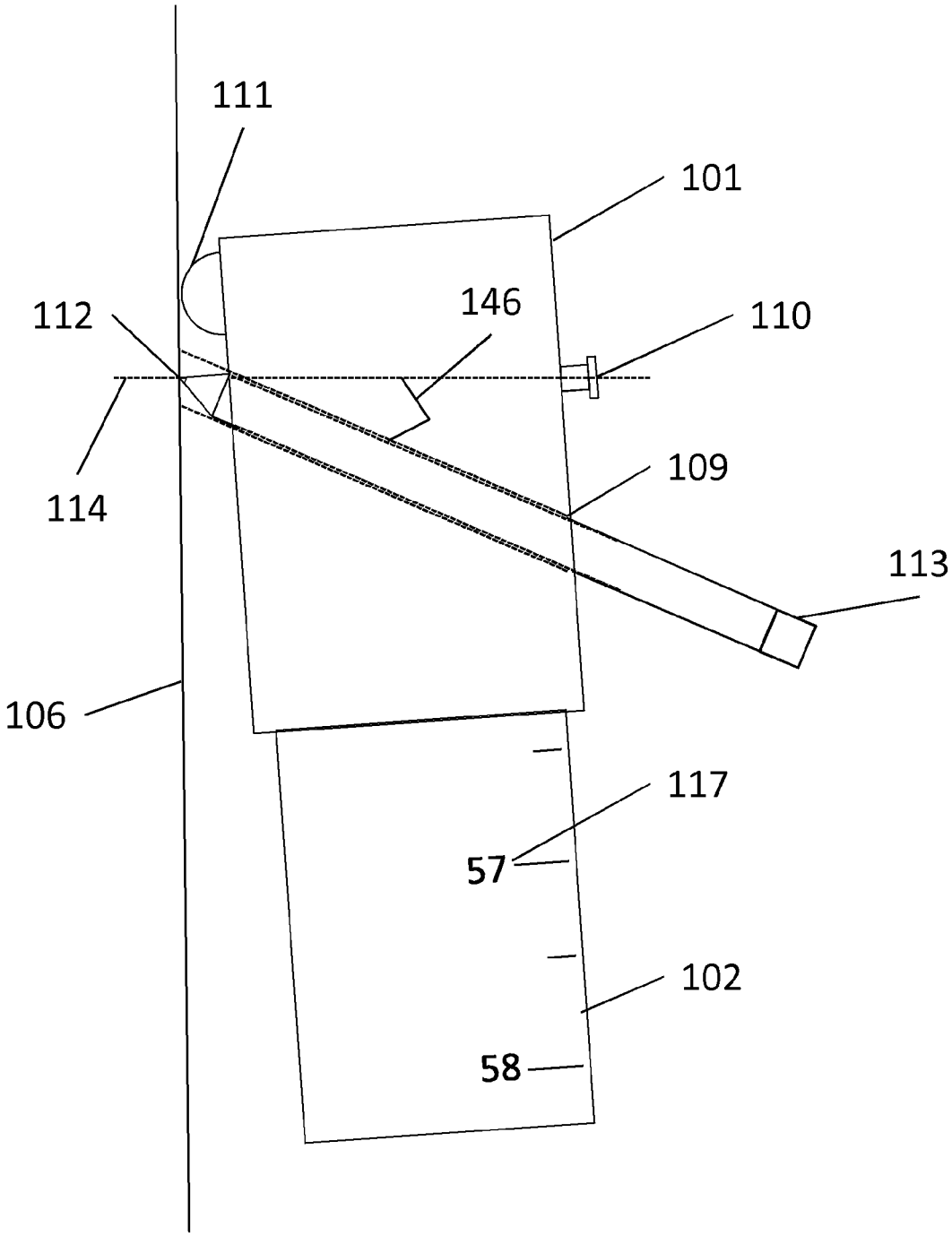
FIG. 8 is a cross sectional view of the picture hanging attachment.

Referring to FIGS. 7 and 8, the top section of the picture locating tool 100 is shown from a rear plan view. As shown in FIG. 7, the picture hanging anchor attachment 101 may include a horizontal indicator 118. The marking device 113 may be positioned within the cavity 120. The horizontal indicator 118 aids the user in aligning multiple ornamental objects on the wall 106. The picture hanging anchor attachment 101 is attached to the top section of the adjustable extension pole 102, and the marking device 113 is positioned in the marking bore 109. In this embodiment, the exit point of the marking bore 109 allows the user to mark the wall 106 with the marking device 113 at the proper picture hanging location. The angle of the marking bore 109 is configured on the picture hanging anchor attachment 101 in a manner that allows a tip of the marking device 113 to mark the wall 106 at the accurate picture anchor location 112 projected horizontally from the picture anchor point 110 on the picture hanging anchor attachment 101 along a virtual picture hanging axis 114. The set of contact bumpers 111 support the picture locating tool 100 as shown in FIG. 2 against the wall 106.

Figure 9:
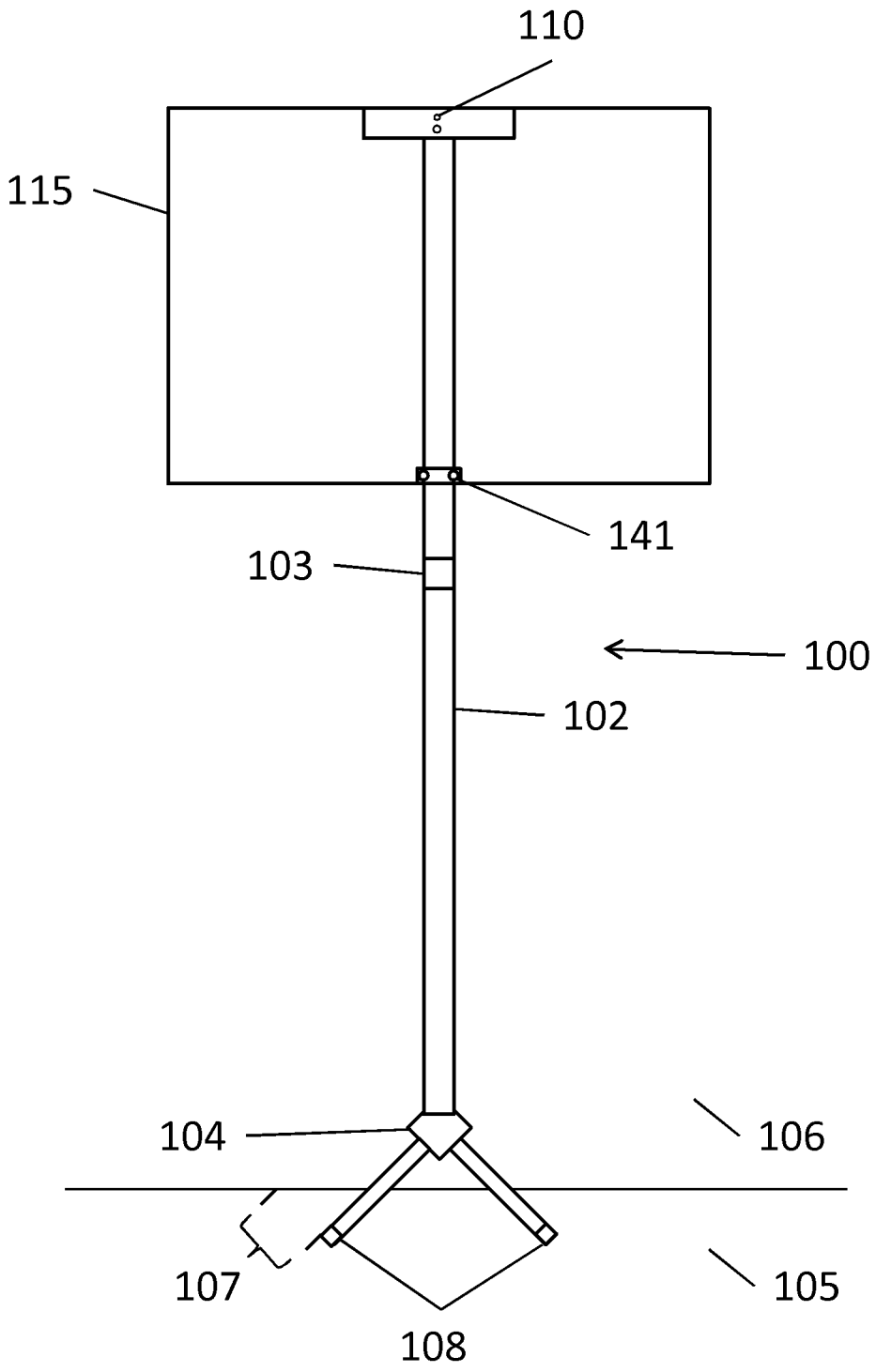
FIG. 9 is a plan view of the picture locating tool with a picture hanging on a picture anchor point on the picture hanging attachment (front).

Referring to FIG. 9, the user has temporarily positioned the ornamental object 115 on the picture anchor 110 at a desired height measurement by adjusting the length of the adjustable extension pole 102 with the outer lock device 103. The picture frame stabilizer ring 141 is employed to ensure the picture is perfectly level, square and presents a uniform appearance to the user.

Figure 10:
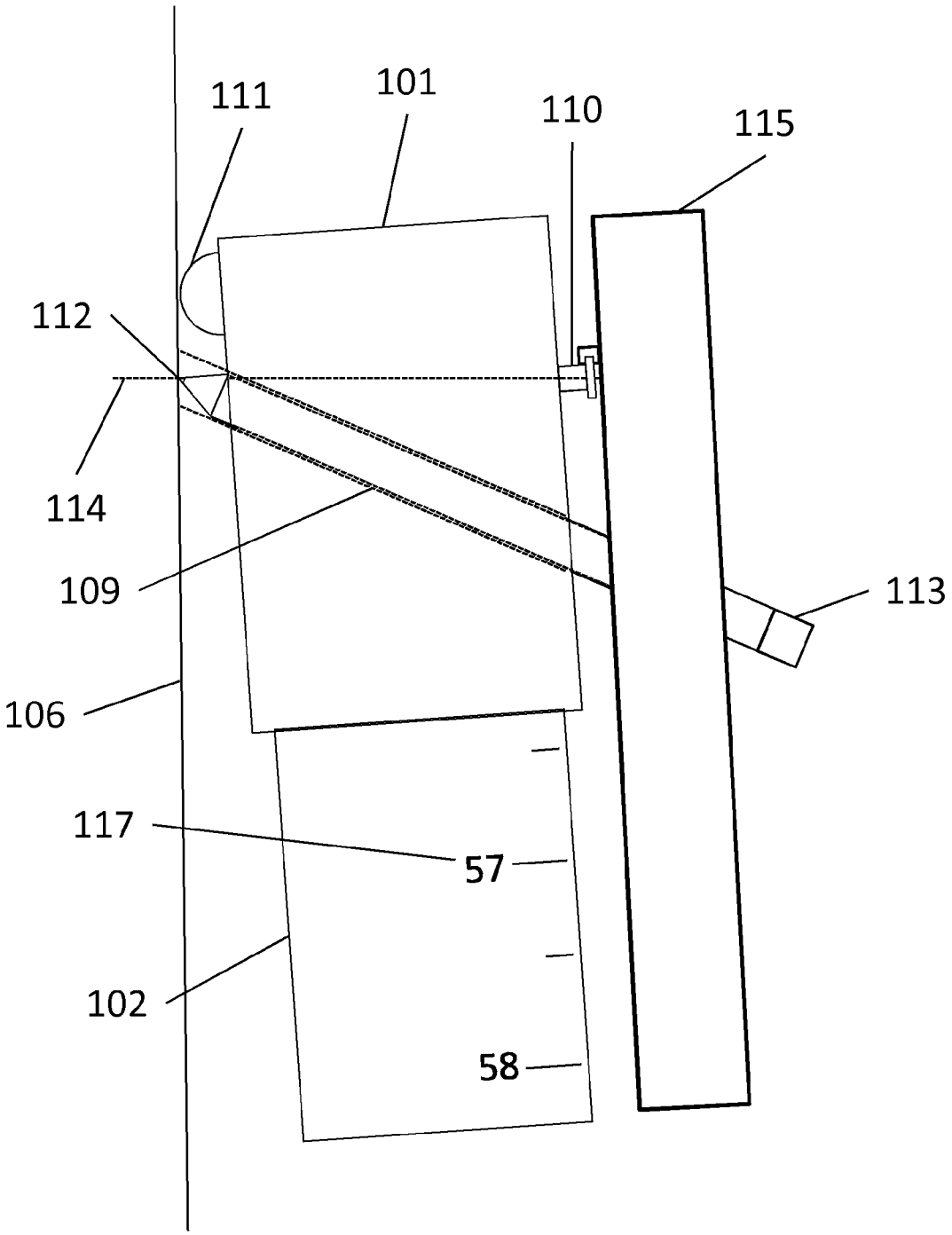
FIG. 10 is a plan view of the picture locating tool with a picture hanging on the picture anchor point on the picture hanging attachment (side).

Referring to FIG. 10, once the user is satisfied with the picture hanging location, the user removes the ornamental object 115 from the picture anchor 110 and inserts the marking device 113 through the marking bore 109 to mark the wall 106 at the location that corresponds with the picture anchor location 112, projected horizontally from the picture anchor point 110 on the picture hanging anchor attachment 101 along the virtual picture hanging axis 114 of the anchor 110. This embodiment illustrates the accuracy of the mark on the wall as it corresponds to the ornamental object 115 positioned on the picture anchor point 110.

Figure 11:
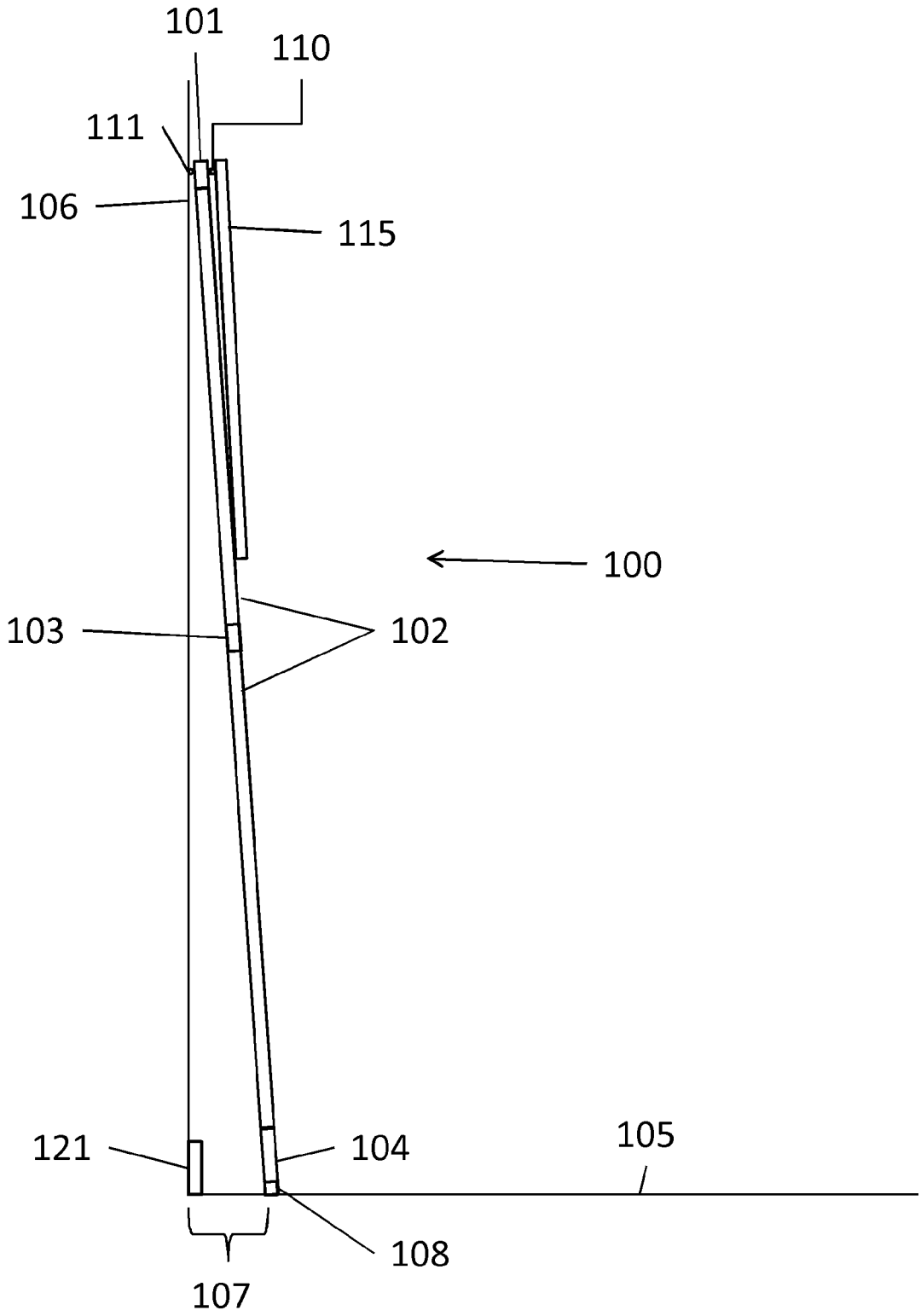
FIG. 11 is a plan view of the picture locating tool with a picture hanging on the picture hanging attachment (side).
Figure 12:
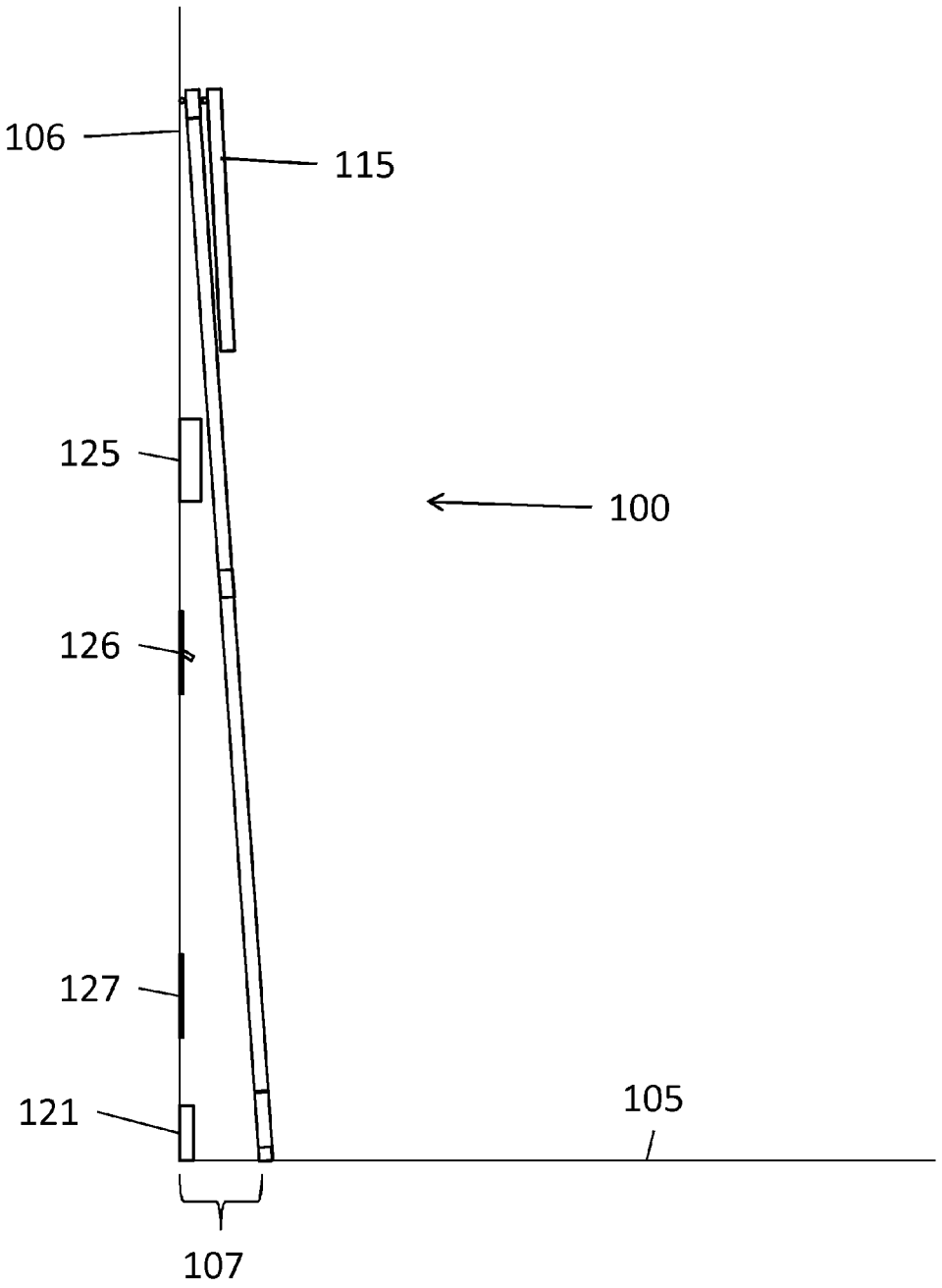
FIG. 12 is a plan view of the picture locating tool with a picture hanging on the picture hanging attachment positioned relative to a thermostat, light switch, power outlet and floor molding (side).

Referring to FIG. 11, the picture locating tool 100 is shown in use where there is a floor molding 121. Referring to FIG. 12 the picture locating tool 100 is shown in use where there is floor molding 121, a power outlet 127, a light switch 126 and a thermostat control box 125. FIGS. 11 and 12 demonstrate that the picture locating tool 100 can successfully hang ornamental objects 115 over commonly occurring wall protrusions such as floor molding 121, a power outlet 127, a light switch 126 and a thermostat control box 125. As shown in FIGS. 11 and 12, the user has extended the adjustable extension pole 102 to a desired picture height, placed the bi-pod feet 104 approximately 5 inches from the wall 106, and ensured the contact bumpers 111 on the picture hanging anchor attachment 101 are properly positioned flush against the wall 106.

Figure 13:
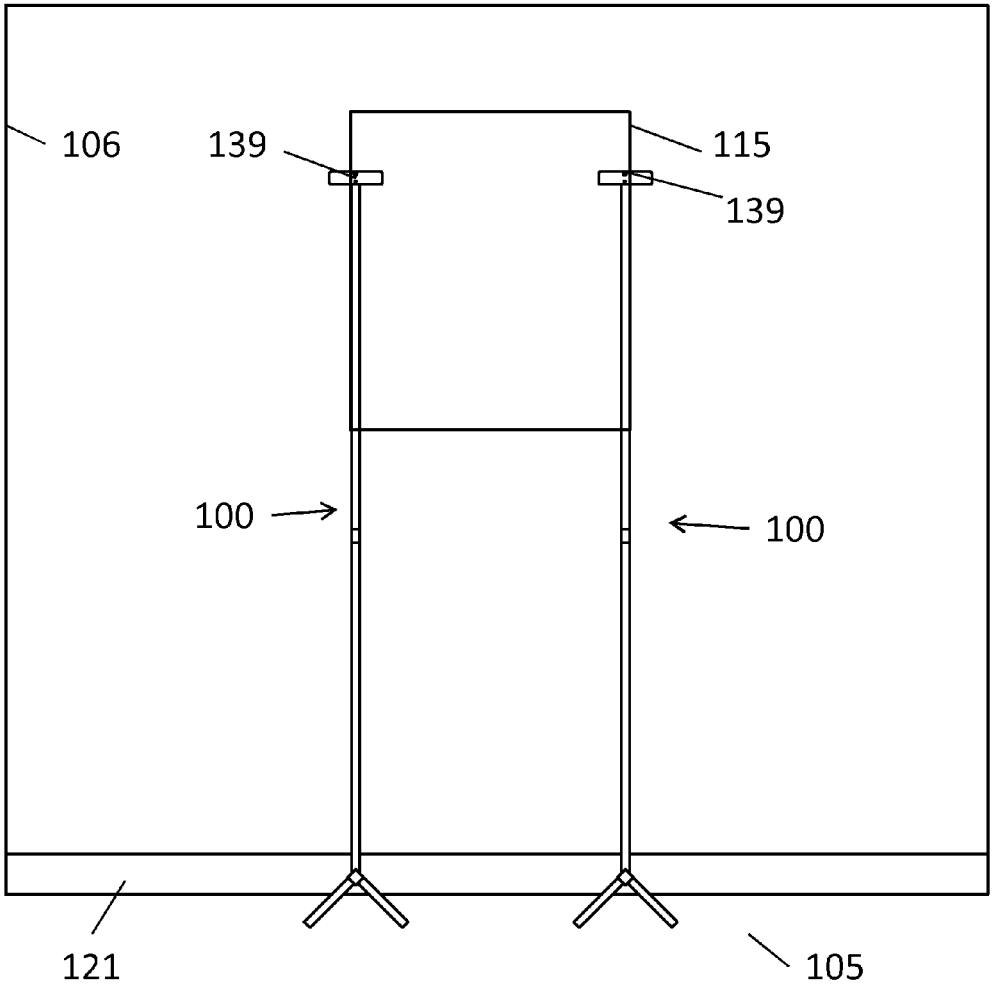
FIG. 13 is a plan view of a picture being supported by two picture locating tools.

Referring to FIG. 13, a pair of picture locating tools 100 is shown jointly supporting an ornamental object 115 having two hanging points 139.

The picture locating tool 100 is used to position an ornamental object 115 on a vertical wall 106. The ornamental object 115 may include but is not limited to a framed picture, a decorative plate, or some other similar object. Preferably, the locating tool 100 includes the adjustable extension pole 102, which extends along a longitudinal axis 114. The extension pole 102 extends between a first end and a second end. As used herein, the first end refers to a generally lower or bottom end of the extension pole 102, and the second end refers to a generally upper or top end of the extension pole 102. The extension pole 102 may include any device capable of adjusting a length along the longitudinal axis 114 between the first end and the second end of the pole 102. For example, the extension pole 102 may include a lower section telescopically engaged with an upper section, and include a lock device 103 configured for securing the lower section relative to the upper section.

The base 104 is attached to the first end of the extension pole 102. The base 104 supports the first end of the extension pole 102. When properly positioned, the base 104 supports the extension pole 102 in a laterally offset position relative to the wall 106. Preferably, and as shown throughout the Figures, the base 104 includes a bi-pod base 104 having a first leg 142 and a second leg 143. The first leg 142 and the second leg 143 of the bi-pod base 104 are disposed in a co-planar relationship relative to the extension pole 102. Each of the first leg 142 and the second leg 143 extend from the extension pole 102 to a distal foot, while diverging from each other to define a support width between the distal foot of the first leg 142 and the distal foot of the second leg 143. Preferably, the support width is equal to or less than twelve inches, which allows the bi-pod base 104 to be positioned on a single tread of a stairway in order to hang ornamental objects 115 in a stairwell. It should be appreciated that the base 104 may be configured differently than shown and described herein.

The picture hanging anchor attachment 101 is attached to the second end of the extension pole 102. The picture hanging anchor attachment 101 includes an anchor 110 that is disposed on an axis 114 of the anchor 110. The axis 114 of the anchor 110 extends through the picture hanging anchor attachment 101, transverse relative to the wall 106. When the picture locating tool 100 is properly positioned relative to the wall 106, the axis 114 of the anchor 110 is substantially perpendicular relative to the wall 106, and is also substantially horizontal. The anchor 110 is configured for supporting the ornamental object 115 in a laterally offset position relative to the wall 106, i.e., in a spaced relationship relative to the wall 106. The anchor 110 may include any suitable type of hanging hardware capable of temporarily supporting the ornamental object 115.

The picture hanging anchor attachment 101 may include at least one bumper 111 that is attached adjacent an upper vertical edge of the picture hanging anchor attachment 101. As shown, the picture hanging anchor attachment 101 includes a pair of bumpers 111 disposed at opposite horizontal ends of the picture hanging anchor attachment 101. The bumpers 111 are positioned opposite the anchor 110 and are configured for engaging the wall 106. The bumpers 111 include a generally non-abrasive material and are configured to engage the surface of the wall 106 without marking, denting or otherwise damaging the surface of the wall 106. When the hanging tool is positioned for hanging the ornamental object 115, the extension pole 102 is supported relative to the wall 106 and the floor 105 by only the bumpers 111, the distal foot of the first leg 142 and the distal foot of the second leg 143, with the distal feet of the first leg 142 and the second leg 143 laterally spaced from the wall 106. Accordingly, when the hanging tool is positioned for hanging the ornamental object 115, the bumpers 111, the distal foot of the first leg 142 and the distal foot of the second leg 143 are configured to support the extension pole 102 in an angled relationship relative to the wall 106. Preferably, the extension pole 102 is positioned at an angle of between two degrees (2°) and twelve degrees (12°) relative to the wall 106, shown generally at 145 in FIG. 2.

The picture hanging anchor attachment 101 defines a marking bore 109. The marking bore 109 is offset from the anchor 110, and is angled relative to the substantially horizontal axis 114 of the anchor 110. The marking bore 109 is configured for positioning a marking device 113, e.g., a pencil or a pen, at an intersection of the axis 114 of the anchor 110 and the wall 106. When properly positioned, the marking device 113 may be used to transfer a vertical position of the anchor 110 to the wall 106. Accordingly, once the desired position of the ornamental object 115 is located, the anchor 110 on the picture hanging anchor attachment 101 represents the exact vertical and lateral position at which to attach the hanging hardware to the wall 106. The marking device 113 may then be inserted through the marking bore 109 to mark the intersection of the axis 114 of the anchor 110 and the wall 106, which is the point at which to attach the hanging hardware to achieve the desired final location of the ornamental object 115.

Preferably, and as shown, the marking bore 109 is vertically offset from the axis 114 of the anchor 110. However, it should be appreciated that the marking bore 109 may alternatively be horizontally offset from the axis 114 of the anchor 110. Preferably, and as shown, the marking bore 109 is vertically offset below the axis 114 of the anchor 110. However, it should be appreciated that the marking bore 109 may alternatively be vertically offset above the axis 114 of the anchor 110. The marking bore 109 and the axis 114 of the anchor 110 form an angle of between six degrees (6°) and thirty three degrees (33°) therebetween, shown generally at 146 in FIG. 8. This angle is configured so that, when the hanging tool is properly positioned against the wall 106, the marking device 113 may extend through the marking bore 109 and contact the wall 106 at the intersection of the axis 114 of the anchor 110 and the wall 106.

As noted above, the locating tool 100 may include a stabilizer ring. The stabilizer ring is moveably secured to the extension pole 102, and is disposed between the first end and the second end of the extension pole 102. The stabilizer ring is configured for stabilizing a lower edge of the ornamental object 115. The stabilizer ring may be positioned vertically along the longitudinal axis 114, and helps stop the ornamental object 115 from wobbling and/or twisting while being supported by the hanging tool, thereby providing the user with a more realistic representation of how the ornamental object 115 will appear if secured to the wall 106 at that location.

The extension pole 102 may further include indicia 117 indicating a vertical height from the wall 106 to the anchor 110. Furthermore, the anchor attachment 101 may include indicia 118, 119 indicating a horizontal offset and/or a vertical offset respectively from the anchor 110. The indicia 117, 118, 119 on the extension pole 102 and/or the picture hanging anchor attachment 101 may include a scale, writing, measurements or other markings indicating the relative position of the anchor 110 to the floor 105 and/or the anchor attachment 101.

The picture hanging anchor attachment 101 may define the cavity 120. The cavity 120 is configured for storing the marking device 113 when not being used to mark the desired location on the wall 106. Preferably, the cavity 120 is disposed on a top surface of the anchor attachment 101 and extends downward. The cavity 120 may be sized to accept a standard sized pencil and/or pen. However, it should be appreciated that the cavity 120 may be positioned at some other location on the anchor attachment 101 and/or the extension pole 102, and may be configured in some other manner than shown and described herein.

To hang an ornamental object 115, a user temporarily hangs the ornamental object 115 on the anchor 110 of the picture hanging anchor attachment 101, and adjusts the ornamental object 115 for level. After the user has stepped back from the ornamental object 115 to determine if the hanging location is displaying the ornamental object 115 at the desired location, the user can adjust the hanging location by moving the picture hanging locating tool 100, with the ornamental object 115 hung thereon, laterally, i.e., left or right, as necessary to select a desired lateral location of the ornamental object 115 on the wall 106. The user can adjust for height by removing the ornamental object 115, loosening the adjustable extension pole outer locking device 103 and adjusting up or down using the height measurement indicator 117 shown in FIG. 5. The user must ensure the contact bumpers 111 on the picture hanging anchor attachment 101 are flush against the wall 106, as shown in FIG. 6, and then retighten the adjustable extension pole locking device 103. Once the hanging location is determined, the user removes the ornamental object 115 from the picture hanging anchor attachment 101 while ensuring the locating tool 100 does not move. Should the locating tool 100 accidentally move during this process, the user repositions the ornamental object 115 on the anchor 110 of the picture hanging anchor attachment 101, adjusts the ornamental object 115 for level, and after confirming the hanging location, carefully removes the ornamental object 115 from the picture hanging anchor attachment 101 ensuring again that the locating tool 100 does not move. The user removes the marking device 113 from the cavity 120, inserts the marking device 113 through the marking bore 109, and marks the wall 106, which corresponds with the picture location 112 projected horizontally from the picture anchor point 110 on the picture hanging anchor attachment 101 along the virtual picture hanging axis 114 as shown in FIG. 8. The user can then install on the wall the appropriate hanging hardware, and thus hangs the ornamental object 115.

Although the applicant has shown and described herein the picture locating tool 100 which, when leaned against the wall 106, can temporarily hang an ornamental object 115 and allow a user to mark on the wall 106 the picture hanging location 112 of the ornamental object 115, the locating tool 100 may be altered by modifying the components of the picture locating tool 100. For example, the locating tool 100 may be modified by altering the distance 107 the base 104 is located from the wall 106. As described above, the marking bore 109 in the anchor attachment 101 is angled in such a manner that it corresponds to the angle created by placing the bi-pod base 104 five inches from the wall 106. However, these two angles could be modified, allowing for a similar result. Furthermore, the marking bore 109 in the picture hanging anchor attachment 101 could be placed at different locations, while achieving a similar result as the locating tool 100 shown and described herein. The extension pole 102 could be modified with an inner locking device and the bi-pod base 104 could be substituted with a T-shape, cylindrical or block configuration. The marking bore 109 in the picture hanging anchor attachment 101 could be modified to allow insertion of any suitable marking device 113 to mark the picture anchor location 112, such as a nail or screwdriver, pen, etc. Furthermore, a mechanical system in the picture hanging anchor attachment 101 could be substituted that marks the picture anchor location 112 on the wall 106. The contact bumpers 111 could be modified to define a ridge that extends along the picture hanging anchor attachment used to make contact with the wall.

While the best modes for carrying out the invention have been described in detail, those familiar with the art to which this invention relates will recognize various alternative designs and embodiments for practicing the invention within the scope of the appended claims.

The invention claimed is:

1. A locating tool for positioning an ornamental object on a wall, the locating tool comprising:

a pole extending along a longitudinal axis between a first end and a second end;

a base attached to the first end of the pole and configured for supporting the first end of the pole in a laterally offset position relative to the wall; and an anchor attachment attached to the second end of the pole and including an anchor disposed on an axis extending transverse relative to the wall and through the anchor attachment, wherein the anchor is configured for supporting the ornamental object in a laterally offset position relative to the wall;

wherein the anchor attachment defines a marking bore offset from the anchor and angled relative to the axis of the anchor and configured for positioning a marking device at an intersection of the axis of the anchor and the wall to transfer a vertical position of the anchor to the wall.

2. A locating tool as set forth in claim 1 wherein the marking bore is vertically offset from the axis of the anchor.

3. A locating tool as set forth in claim 2 wherein the marking bore is vertically offset below the axis of the anchor.

4. A locating tool as set forth in claim 3 wherein the marking bore and the axis of the anchor form an angle of between six degrees (6°) and thirty three degrees (33°).

5. A locating tool as set forth in claim 1 wherein the base includes a bi-pod base having a first leg and a second leg.

6. A locating tool as set forth in claim 5 wherein the first leg and the second leg of the bi-pod base are disposed in a co-planar relationship relative to the pole.

7. A locating tool as set forth in claim 6 wherein each of the first leg and the second leg extend from the pole to a distal foot, while diverging from each other to define a support width between the distal foot of the first leg and the distal foot of the second leg.

8. A locating tool as set forth in claim 7 wherein the support width is equal to or less than twelve inches.

9. A locating tool as set forth in claim 7 wherein the anchor attachment includes at least one bumper attached adjacent an upper vertical edge of the anchor attachment and positioned opposite the anchor for engaging the wall.

10. A locating tool as set forth in claim 9 wherein the pole is supported relative to the wall and the floor by only the at least one bumper, the distal foot of the first leg and the distal foot of the second leg, wherein the at least one bumper, the distal foot of the first leg and the distal foot of the second leg are configured to support the pole in an angled relationship relative to the wall at an angle of between two degrees (2°) and twelve degrees (12°).

11. A locating tool as set forth in claim 1 further comprising a stabilizer ring moveable secured to the pole between the first end and the second end thereof, wherein the stabilizer ring is configured for stabilizing a lower edge of the ornamental object.

12. A locating tool as set forth in claim 1 wherein the pole includes indicia indicating a vertical height from a wall to the anchor.

13. A locating tool as set forth in claim 1 wherein the anchor attachment includes indicia indicating at least one of a horizontal offset or a vertical offset from the anchor.

14. A locating tool as set forth in claim 1 wherein the anchor attachment defines a cavity configured for storing the marking tool.

15. A picture locating tool for positioning a picture at a desired location on a wall, the picture locating tool comprising:

an adjustable extension pole extending along a longitudinal axis between a first end and a second end;

a bi-pod base having a first leg and a second leg attached to the first end of the extension pole and disposed in a co-planar relationship relative to the extension pole, wherein each of the first leg and the second leg extend from the extension pole to a distal foot, while diverging from each other to define a support width between the distal foot of the first leg and the distal foot of the second leg for supporting the first end of the extension pole in a laterally offset position relative to the wall;

wherein the support width is equal to or less than twelve inches; and an anchor attachment attached to the second end of the extension pole and including an anchor disposed on an axis extending transverse relative to the wall and through the anchor attachment, wherein the anchor is configured for supporting the ornamental object in a laterally offset position relative to the wall;

wherein the anchor attachment includes at least one bumper attached adjacent an upper vertical edge of the anchor attachment and positioned opposite the anchor for engaging the wall;

wherein the extension pole is supported relative to the wall and the floor by only the at least one bumper, the distal foot of the first leg and the distal foot of the second leg;

wherein the anchor attachment defines a marking bore vertically offset below the anchor and angled relative to the axis of the anchor at an angle of between six degrees (6°) and thirty three degrees (33°), wherein the marking bore is configured for positioning a marking device at an intersection of the axis of the anchor and the wall to transfer a vertical position of the anchor to the wall; and wherein the at least one bumper, the distal foot of the first leg and the distal foot of the second leg are configured to support the extension pole in an angled relationship relative to the wall at an angle of between two degrees (2°) and twelve degrees (12°) so that the marking bore is properly aligned with the axis of the anchor to position the marking tool at the intersection of the axis of the anchor and the wall.

16. A method of hanging an ornamental object on a wall, the method comprising:

extending a locating tool to a desired length sufficient to support the ornamental object at a desired height on a wall;

positioning a base of the locating tool at a pre-determined distance from the wall;

leaning the locating tool against the wall until a bumper disposed at an upper vertical edge of an anchor attachment of the locating tool contacts the wall;

laterally positioning the locating tool relative to the wall to select a desired lateral location for the ornamental object on the wall;

inserting a marking tool through a marking bore defined by the anchor attachment, wherein the marking bore is offset relative to an anchor of the anchor attachment and angled relative to an axis of the anchor such that the marking tool contacts the wall at an approximate intersection between the axis of the anchor and the wall;

marking the wall with the marking tool to transfer the vertical and lateral location of the anchor to the wall; and installing hanging hardware on the wall at the marked vertical location to support the ornamental object.

17. A method as set forth in claim 16 wherein positioning the base of the locating tool includes positioning the base of the locating tool a horizontal distance from the wall equal to or greater than three inches.

18. A method as set forth in claim 17 further comprising hanging the ornamental object on the anchor of the anchor attachment.

19. A method as set forth in claim 18 further comprising adjusting a length of the extension pole to vertically position the ornamental object at a desired vertical position.

20. A method as set forth in claim 19 further comprising removing the ornamental object from the anchor of the anchor attachment without moving the locating tool.

* * * * *